US010767443B2

(12) United States Patent
Bellavance et al.

(10) Patent No.: US 10,767,443 B2
(45) Date of Patent: Sep. 8, 2020

(54) BURST PORT SUB WITH DISSOLVABLE BARRIER

(71) Applicant: Trican Completion Solutions Ltd, Calgary, Alberta (CA)

(72) Inventors: Mike Bellavance, Calgary (CA); Todd Atkinson, Calgary (CA); Tore Sørheim, Randaberg (NO)

(73) Assignee: TRICAN COMPLETION SOLUTIONS LTD, Calgary, Alberta (CA)

( * ) Notice: Subject to any disclaimer, the term of this patent is extended or adjusted under 35 U.S.C. 154(b) by 239 days.

(21) Appl. No.: 15/002,702

(22) Filed: Jan. 21, 2016

(65) Prior Publication Data

US 2016/0208575 A1 Jul. 21, 2016

Related U.S. Application Data

(60) Provisional application No. 62/105,993, filed on Jan. 21, 2015.

(51) Int. Cl.
*E21B 34/06* (2006.01)

(52) U.S. Cl.
CPC ..... *E21B 34/063* (2013.01)

(58) Field of Classification Search
CPC ..... E21B 34/063
See application file for complete search history.

(56) References Cited

U.S. PATENT DOCUMENTS

| | | | | |
|---|---|---|---|---|
| 5,005,649 | A * | 4/1991 | Smith | E21B 34/063 166/177.5 |
| 7,726,406 | B2 * | 6/2010 | Xu | E21B 23/00 166/317 |
| 9,482,069 | B2 * | 11/2016 | Powers | E21B 33/1208 |
| 9,567,831 | B2 * | 2/2017 | Ward | E21B 34/063 |
| 2012/0111566 | A1 * | 5/2012 | Sherman | E21B 34/063 166/297 |
| 2015/0315873 | A1 * | 11/2015 | Mailand | E21B 34/125 166/307 |
| 2020/0095845 | A1 * | 3/2020 | Watkins | E21B 23/04 |

* cited by examiner

*Primary Examiner* — David J Bagnell
*Assistant Examiner* — Jonathan Malikasim
(74) *Attorney, Agent, or Firm* — Wenderoth, Lind & Ponack, L.L.P.

(57) ABSTRACT

The present invention relates to burst port subs (BPS) 120 allowing for a tubing 100 or a liner 200 or a casing 200 in a borehole 300 to be opened at a predetermined pressure and further providing a delayed opening sequence due to a dissolvable barrier 400, 500 arranged in a port 440, 540 of the sub 120. The present invention relates further to a downhole system comprising a predetermined number of such burst port subs (BPS) 120.

13 Claims, 5 Drawing Sheets

BURST PORT SUB WITH DISSOLVABLE BARRIER

TECHNICAL FIELD

The present invention relates to burst port subs (BPS) allowing for at least one of: a tubing, a liner and a casing, in a borehole to be opened at a predetermined pressure and further providing a delayed opening sequence. The present invention relates further to a downhole system comprising a predetermined number of such burst port subs (BPS).

BACKGROUND OF THE INVENTION

Some different tools and methods that are available today and have a delayed opening sequence are mentioned below:

- Delayed opening valves having oil metering systems allowing pressure to initiate the metering sequence, and actual opening of these valves will be delayed with the time it takes to evacuate a predetermined volume of oil;
- Indexing tools requiring a number of pressure cycles for each tool to open up;
- Battery powered tools which will open after a predetermined time/pressure.

SUMMARY OF THE INVENTION

It is an object of the invention to provide burst port subs (BPS) for a tubing or a liner or a casing in a borehole and adapted to be opened at a predetermined pressure and with a delayed opening sequence.

Another object of the invention is to provide tools, systems and methods having delayed opening sequence and being improved with respect to the known technique.

Yet another object of the invention is to provide tools, systems and methods having delayed opening sequence and representing alternatives to the known technique.

According to a first aspect of the invention, this is achieved with a burst port sub having a dissolvable barrier.

According to another aspect of the invention, this is achieved with a downhole system comprising a predetermined number of such burst port subs.

Burst port subs (BPS)/burst disk subs allow a closed tubing or liner or casing system to be opened at a predetermined pressure. Once this pressure is reached the opening from the inside to the outside of the tubular string is initiated thus providing a fully opened conduit, and the tubular string is no longer pressure containing.

This invention will allow for the BPS to be pressurized in order to burst the BPS disk therein and not immediately open up for communication with the outside. This will allow a set time of from e.g. about 0,5-1 hour to e.g. about 2-3 days before the dissolvable barrier in the port of the BPS is dissolved and the open conduit is established.

The invention relates to a burst port sub comprising:

at least one port;

a burst disk arranged on the inner end of the port; and a dissolvable barrier.

The port can be radial. The burst disk can be adapted to burst at a predetermined pressure. The dissolvable barrier can be arranged within the port. The dissolvable barrier can be adapted to dissolve after a predetermined period of time in order to provide an open conduit. The dissolvable barrier can have the shape of one of: a ball, a disc and a plug. The dissolvable barrier can be made of a material being dissolvable by the fluids in the well. The fluids can be pumped in the well after the installation of the BPS. The fluids can have been pumped into the well, before the installation of the BPS. The fluids can already be present in the well.

The burst port sub can also comprise a cap. The cap can be arranged on the outer end of the port.

Furthermore, the burst port sub can comprise a chamber having an atmospheric pressure. The chamber can contain the dissolvable barrier. The chamber can be arranged in the port and between the burst disk and the cap.

The burst port sub can further comprise an insert. The inset can be adapted to be arranged in the port. The dissolvable barrier can be arranged in the insert. The insert can further comprise at least one of: the burst disk, the cap and the atmospheric chamber. The burst disk can have a predetermined thickness. The thickness can set or determine at which predetermined pressure the burst disk will burst or break. The predetermined pressure for bursting the burst disk in the sub port can be in the range from approximately 200 psi to approximately 9000 psi, and particularly from approximately 500 psi to approximately 5000 psi.

The predetermined period of time for dissolving the dissolvable barrier can be in the range from approximately 30 minutes to approximately 3 days, and particularly from approximately 1 hour to approximately 2 days.

The invention relates also to a downhole system comprising at least one burst port sub according to the invention. Said at least one burst port sub can be peripherally arranged in at least one of: a tubing, a casing and a liner. The downhole system can be adapted for at least one of: an open hole application and a cemented application.

The main features of this invention are given in the independent claims. Additional features of the present invention are given in the dependent claims.

BRIEF DESCRIPTION OF THE DRAWINGS

These and other aspects of the invention are apparent from and will be further elucidated, by way of example(s), with reference to the drawings, wherein.

DETAILED DESCRIPTION OF THE EMBODIMENTS

Figure 1:
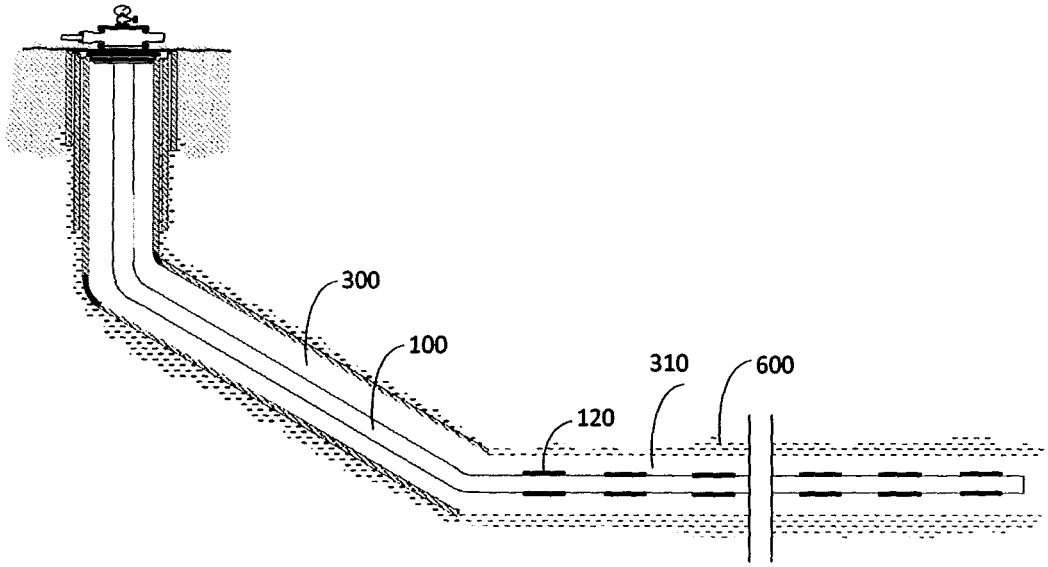
FIG. 1 illustrates a first embodiment of the present invention showing a system comprising a predetermined number of burst port subs.

FIG. 1 illustrates a downhole system, according to the present invention, arranged in an open hole 300 and comprising at least one burst port sub 120. There can be a predetermined number of burst port subs, BPS, 120. Each burst port sub 120 is peripherally arranged in a tubing 100 in the well 300. The tubing 100 can be a production tubing. The term "open hole" is used for wells 300 where there is no liner/casing in the pay zone 310 of the formation 600.

Figure 2:
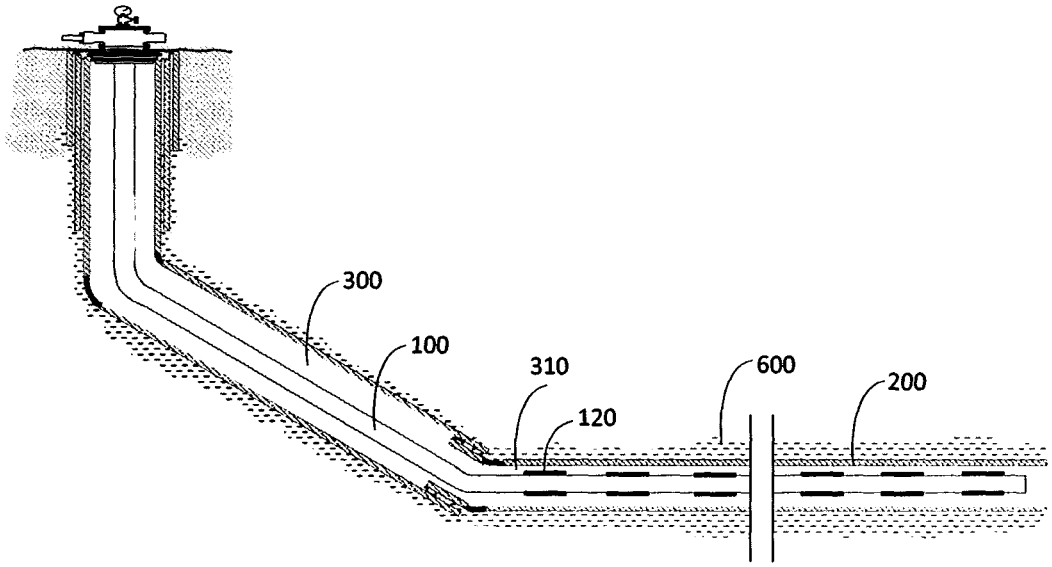
FIG. 2 illustrates a second embodiment of the present invention showing a system comprising a predetermined number of burst port subs.

FIG. 2 illustrates another downhole system, according to the present invention, for cemented application and comprising at least one burst port sub 120. There can be a predetermined number of burst port subs, BPS, 120. Each burst port sub 120 is peripherally arranged in a tubing 100 in a well 300. Furthermore, a casing 200 or a liner 200 is cemented in the well 300. The tubing 100 is arranged within the casing 200 or the liner 200, and thus an annulus 300 is created therebetween.

Figure 3:
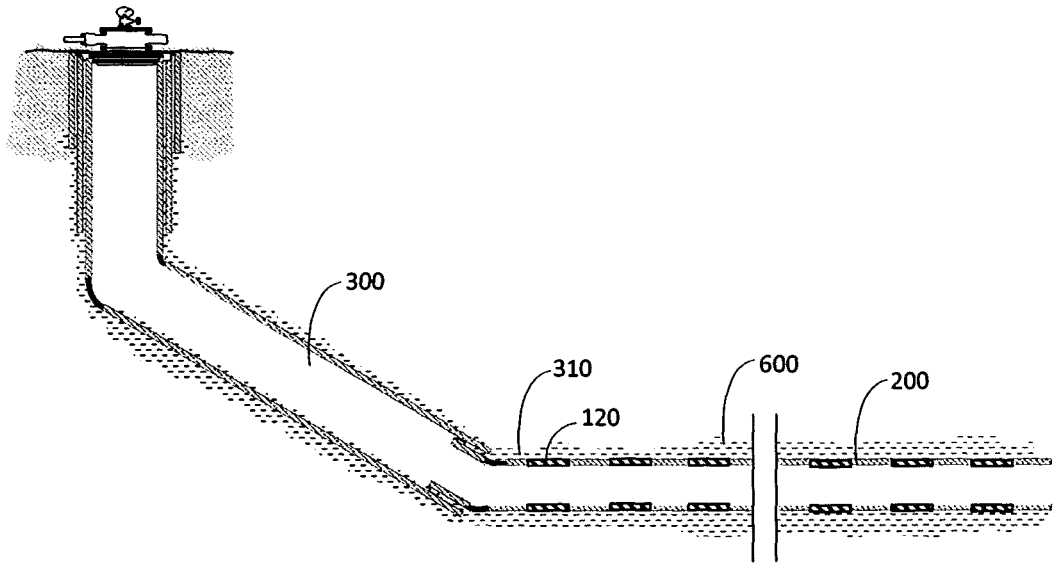
FIG. 3 illustrates a third embodiment of the present invention showing a system comprising a predetermined number of burst port subs.

FIG. 3 illustrates yet another downhole system, according to the present invention, for cemented application and comprising at least one burst port sub 120. There can be a predetermined number of burst port subs, BPS, 120. Each burst port sub 120 is peripherally arranged in a liner 200 cemented in a well 300.

As illustrated in FIG. 1-3, each burst port sub 120 can be arranged in at least one of: a liner 200, a casing 200 and a tubing 100. Each burst port sub 120 can be used in an open hole or cemented application.

Each burst port sub 120 can be arranged as an integrated part of at least one of: the liner 200, the casing 200, the tubing 100, and any section thereof. Alternatively, each burst port sub 120 can be arranged peripherally onto the outside surface of at least one of: the liner 200, the casing 200 and the tubing 100. Alternatively, each burst port sub 120 can be arranged peripherally onto the inside surface of at least one of: the liner 200, the casing 200 and the tubing 100.

Said at least one burst port subs 120 can be arranged in the area of a reservoir 600 in a subterranean formation 600. The subterranean reservoir 600 can contain at least one of: oil and gas.

The several burst port subs 120 can be arranged with a predetermined distance from each other. Alternatively, a first distance between two neighbouring burst port subs 120 can vary with respect to a second distance between other two neighbouring burst port subs.

The present invention provides a delayed opening sequence of a burst port sub 120. Each burst port sub 120 can be designed to be opened by different pressure.

Figure 4:
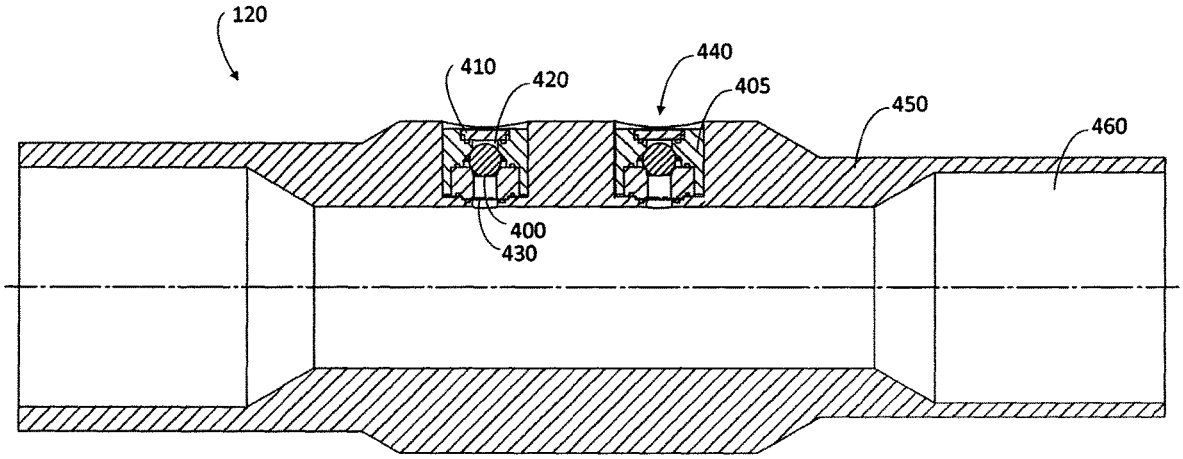
FIG. 4 illustrates a first embodiment of a burst port sub according to the present invention.
Figure 5:
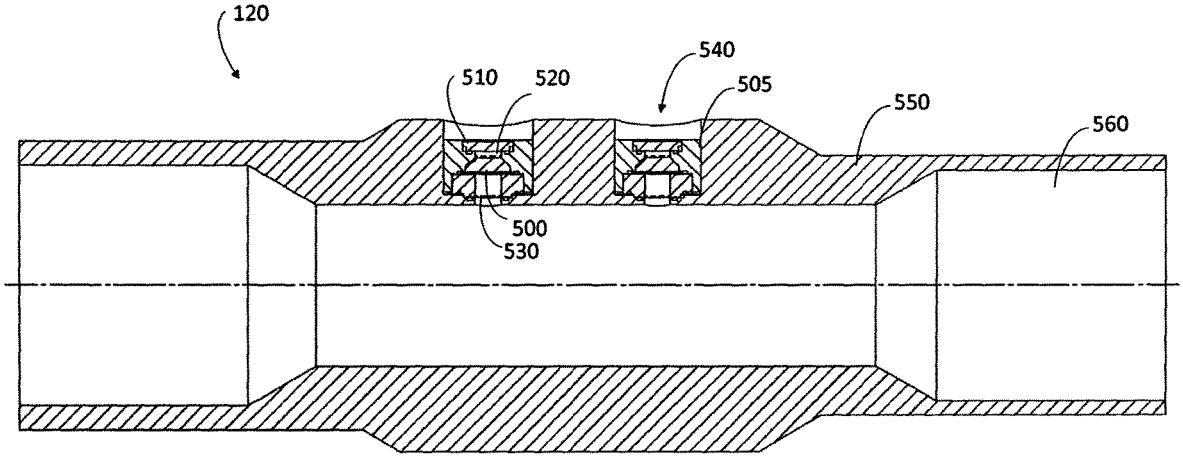
FIG. 5 illustrates a second embodiment of a burst port sub according to the present invention.

The burst port sub 120, according to the invention and shown in FIGS. 4 and 5, utilizes a combination of a burst disk 430, 530 and a dissolvable barrier 400, 500.

FIG. 4 shows one embodiment of a burst port sub 120 according to the invention.

The sub 120 can comprise at least one radial port 440 arranged in the sub 120 body 450. An insert 405 can be arranged in the port 440. The insert 405 can for example be screwed in the port 440. The insert 405 can comprise and hold in place a dissolvable barrier 400. In this embodiment, the dissolvable barrier 400 has the form of a ball 400. A burst disk 430 can be arranged in the insert 405 and on one end of the insert 405 facing the space 460 within the hollow sub 120. Alternatively, the burst disk 430 can be arranged directly onto the inner end of the port 440, that is on the inside 460 surface of the sub 120 body 450. Furthermore, a cap 410 can be arranged in the insert 405 and on the opposite end of the insert 405, thus insulating away the outside pressure 310 (in FIGS. 1 and 2 being the pressure 310 in the annulus 300; and in FIG. 3 being the pressure 310 in the reservoir 600 or formation 600). Alternatively, the cap 410 can be arranged directly onto the outer end of the port 440, that is on the outside surface of the sub 120 body 450.

As said and in this embodiment the sub 120 body 450 can be a part of at least one of: the liner 200, the casing 200 and the tubing 100. Furthermore, the space 460 within the hollow sub 120 can be a part of the inside of one of: the liner 200, the casing 200 and the tubing 100.

The insert 405 can further comprise a chamber 420 with an atmospheric pressure.

FIG. 5 shows another embodiment of a burst port sub 120 according to the invention.

The sub 120 can comprise at least one radial port 540 arranged in the sub 120 body 550. An insert 505 can be arranged in the port 540. The insert 505 can for example be screwed in the port 540. The insert 505 can comprise and hold in place a dissolvable barrier 500. In this embodiment, the dissolvable barrier 500 has the shape of a disc 500 or a plug 500. A burst disk 530 can be arranged in the insert 505 and on a first end of the insert 505 facing the space 560 within the hollow sub 120. Alternatively, the burst disk 530 can be arranged onto the inner end of port 540, that is on the inside 560 surface of the sub 120 body 550. Furthermore, a cap 510 can be arranged in the insert 505 and on the opposite end of the insert 505, thus insulating away the outside pressure 310 (in FIGS. 1 and 2 being the pressure 310 in the annulus 300; and in FIG. 3 being the pressure 310 in the reservoir 600 or formation 600). Alternatively, the cap 510 can be arranged directly onto the outer end of the port 540, that is on the outside surface of the sub 120 body 550.

As said and in this embodiment the sub 120 body 550 can be a part of at least one of: the liner 200, the casing and the tubing 100. Furthermore, the space 560 within the hollow sub 120 can be a part of the inside of one of: the liner 200, the casing and the tubing 100.

The insert 505 can further comprise a chamber 520 with an atmospheric pressure.

The atmospheric chamber 420, 520 will allow the burst disk 430, 530 to burst at a predetermined pressure inside at least one of: the tubing 100, the liner 200 and the casing 200, and independent of the outside pressure 310. In other words, independent of the differential pressure across at least one of: the tubing 100, the liner 200 and the casing 200. The BPS 120 is in practice independent of the pressure on the outside, because of the atmospheric chamber 420, 520 arranged in the port 440, 540 or in the insert 405, 505 of the BPS 120 body 450, 550. The applied pressure that can be used to burst a chosen burst disk 430, 530 in the sub 120 can for example be in the range from about 200 psi to about 9000 psi, and possibly from about 500 psi to about 5000 psi. The applied pressure should not be limited to the above-mentioned pressure ranges. For example applied pressure over 9000 psi can also be appropriate.

The insert 405, 505 can consist of at least one insert part. This can be so in order to facilitate easy installation of the dissolvable barrier 400, 500, and possibly at least one of: the burst disk 430, 530 and the cap 410, 510.

The burst disk 430, 530 can be a disk/disc with a predetermined thickness that is adapted to burst at a predetermined pressure inside at least one of: the tubing 100, the liner 200 and the casing 200.

The dissolvable barrier 400, 500 can be arranged in a dry and atmospheric chamber 420, 520 arranged in the port 440, 540 of the sub 120 body 450, 550 and thus will not be subject to any exposure of well 300 fluids until the burst disk 430, 530 opens up for fluid from the inside 460, 560 of the BPS 120 in order to contact the dissolvable barrier 400, 500 and start the dissolving process.

In FIGS. 4 and 5, it is illustrated that the BPS/sub 120 can have an internal thread at each sub end (wherein the inside 460, 560 diameter of the sub 120, in the port 440, 540 area, is smaller than the diameter in the rest of the sub 120 body 450, 550, i.e. at both sub 120 ends). These drawings show a box-box thread having screwed a pin end into each side. This allows the sub 120 to be screwed up to at least one of the liner 200, the casing 200 and the tubing 100. Alternatively, the BPS/sub 120 can have an external thread at each sub end.

The dissolvable barrier 400; 500 can be made of a material being dissolvable by fluids in the well 300. The fluids can be pumped into the well 300, and/or they can be already existing or present (e.g. previously pumped) in the well 300 (in FIG. 1-2 this can be done through the tubing 100, while in FIG. 3 this can be done through the well 300). Such material can for example be aluminum/aluminium. Other metals that can dissolve in both acid(s) or liquid(s)/fluid(s) containing salt(s), can also be suitable as a material for the dissolvable barrier 400; 500. Another example can be magnesium or a combination of several metals. The material of the dissolvable barrier 400; 500 can in addition fulfill some requirements for material strength, in addition to the requirement(s) for dissolvability or solubility.

Low internal pressure from the sub 120 can push the cap 410, 510 away from the port 440, 540.

The cap 410, 510 can be made of a material fulfilling some requirements for material strength, such as, but not limited to, e.g. a suitable metal or plastic or composite.

Additionally or alternatively, the cap can be made of a dissolvable material, similar as for the dissolvable barrier.

Once in place, at least one of the tubing 100, the liner 200 and the casing 200, can be pressurized to a pressure required for bursting one or several BPS 120 disks 430, 530 without allowing for loss of pressure to the annulus 300 (se FIGS. 1 and 2). This will allow for applying full tubing 100 and/or liner 200 and/or casing 200 test pressure and for opening a number of disks 430, 530.

After a predetermined period of time, dependent on at least one of: the type of the dissolvable material, pumped fluids, well fluids and well temperature, the dissolvable barrier 400, 500 will dissolve and will thus establish communication through all the BPS subs 120.

Additional modifications, alterations and adaptations of the present invention will suggest themselves to those skilled in the art without departing from the scope of the invention as expressed and stated in the following patent claims.

The invention claimed is:

1. A plurality of burst port subs arranged a predetermined distance from each other, each burst port sub comprising:
- at least one radial port;
- a burst disk arranged on an inner end of the port, the burst disk being adapted to burst at a predetermined pressure;
- a dissolvable barrier arranged within the port, the dissolvable barrier being adapted to dissolve after a predetermined period of time in order to provide an open conduit;
- an insert adapted to be arranged in the port and hold the dissolvable barrier a predetermined distance above the burst disk such that a space is created between the dissolvable disk and the burst disk within the port;
- a cap arranged on an outer end of the port; and
- a chamber with an atmospheric pressure,
- wherein the chamber contains the dissolvable barrier and both the chamber and the dissolvable barrier are arranged in the port and between the burst disk and the cap, and
- the plurality of burst port subs has a delayed opening sequence and each burst port sub of the plurality of burst ports has the delayed opening at a different pressure from another burst port sub.

2. The burst port sub according to claim 1, wherein the dissolvable barrier has the form of one of a ball, a disc and a plug.

3. The burst port sub according to claim 1, wherein the dissolvable barrier is made of a material being dissolvable by at least one fluid in a well.

4. The burst port sub according to claim 3, wherein the material of the dissolvable barrier is metal.

5. The burst port sub according to claim 1, wherein the insert arranged in the port comprises the atmospheric chamber.

6. The burst port sub according to claim 1, wherein the burst disk has a predetermined thickness.

7. The burst port sub according to claim 1, wherein the predetermined period of time for dissolving the dissolvable barrier is from 30 minutes to 3 days.

8. The burst port sub according to claim 7, wherein the predetermined period of time for dissolving the dissolvable barrier is from 1 hour to 2 days.

9. The burst port sub according to claim 1, wherein the predetermined pressure for bursting the burst disk in the sub is in the range from 200 psi to 9000 psi.

10. The burst port sub according to claim 9, wherein the predetermined pressure for bursting the burst disk in the sub is in the range from 500 psi to 5000 psi.

11. The burst port sub according to claim 1, further comprising:
- a first space within the burst port sub; and
- the insert is adapted to be arranged in the port, wherein
- the burst disk is in one end of the insert that faces the first space,
- the cap is in another end of the insert opposite to the one end, and
- the chamber defines the space as a second space between the dissolvable barrier and the burst disk, such that the dissolvable barrier is not subject to any exposure of fluid from the first space until the burst disk opens.

12. A downhole system comprising a casing and a plurality of burst port subs arranged a predetermined distance from each other on the casing, each port sub comprising:
- at least one radial port;
- a burst disk arranged on an inner end of the port, the burst disk being adapted to burst at a predetermined pressure;
- a dissolvable barrier arranged within the port, the dissolvable barrier being adapted to dissolve after a predetermined period of time in order to provide an open conduit;
- an insert adapted to be arranged in the port and hold the dissolvable barrier a predetermined distance above the burst disk such that a space is created between the dissolvable disk and the burst disk within the port;
- a cap arranged on an outer end of the port; and
- a chamber with an atmospheric pressure,
- wherein the chamber contains the dissolvable barrier and both the chamber and the dissolvable barrier are arranged in the port and between the burst disk and the cap, and
- the at least one burst port sub is peripherally arranged in at least one of a tubing, the casing and a liner, and
- the plurality of burst port subs has a delayed opening sequence and each burst port sub of the plurality of burst ports has the delayed opening at a different pressure from another burst port sub.

13. The downhole system according to claim 12, wherein the downhole system is adapted for at least one of an open hole application and a cemented application.

* * * * *